US011376710B2

(12) United States Patent
Liu et al.

(10) Patent No.: US 11,376,710 B2
(45) Date of Patent: Jul. 5, 2022

(54) CYCLONE DUST COLLECTING DEVICE AND GRINDING DEVICE

(71) Applicant: Nanjing Chervon Industry Co., Ltd., Nanjing (CN)

(72) Inventors: Tianliang Liu, Nanjing (CN); Xiangqing Fu, Nanjing (CN); Liang Chen, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 0 days.

(21) Appl. No.: 17/360,575

(22) Filed: Jun. 28, 2021

(65) Prior Publication Data

US 2021/0402564 A1 Dec. 30, 2021

(30) Foreign Application Priority Data

Jun. 29, 2020 (CN) ..... 202010610476.2
Jun. 29, 2020 (CN) ..... 202021237149.9

(51) Int. Cl.
*B24B 55/10* (2006.01)

(52) U.S. Cl.
CPC ..... *B24B 55/102* (2013.01)

(58) Field of Classification Search
CPC ..... B24B 55/102; B24B 23/02; B24B 23/026; B24B 23/04; B24B 23/043; B24B 55/06; B24B 55/10; B24B 55/105; A47L 9/16–1691; A47L 7/0095; A47L 7/00; B23Q 11/0071
USPC ..... 451/456, 357, 358, 359; 285/361, 396, 285/402
See application file for complete search history.

(56) References Cited

U.S. PATENT DOCUMENTS 5,784,750 A * 7/1998 Sankovic ..... F16L 37/248 15/246.2
2004/0226272 A1* 11/2004 Valentini ..... B23Q 11/0046 55/385.1
2005/0037699 A1* 2/2005 Park ..... B24B 23/00 451/344
2005/0198770 A1* 9/2005 Jung ..... A47L 5/30 15/353
2006/0150591 A1* 7/2006 Borinato ..... B23Q 11/0046 55/385.1
2016/0121455 A1* 5/2016 Miller ..... B25F 5/02 451/453
2019/0351528 A1* 11/2019 Wei ..... B25F 5/02

* cited by examiner

*Primary Examiner* — Brian D Keller
*Assistant Examiner* — Jacob Adam Montgomery
(74) *Attorney, Agent, or Firm* — Greenberg Traurig, LLP

(57) ABSTRACT

A cyclone dust collecting device includes a dust collecting box and a separator. The dust collecting box includes a dust entrance and a cavity formed by extension in a first direction. The dust entrance communicates with a dust exhaust channel of a host machine. The separator includes a dust inlet and a cyclone tube. The dust inlet communicates with the dust entrance. The dust inlet is configured to guide the dust exhaust airflow into the cyclone tube. The cyclone tube extends in a second direction and is at least partially disposed in the dust collecting box. The cyclone tube includes a dust outlet and an air outlet. The dust outlet is located in the cavity and the air outlet communicates with an outside of the dust collecting box. The second direction obliquely intersects the first direction.

19 Claims, 13 Drawing Sheets

CYCLONE DUST COLLECTING DEVICE AND GRINDING DEVICE

RELATED APPLICATION INFORMATION

This application claims the benefit under 35 U.S.C. § 119(a) of Chinese Patent Application No. CN 202010610476.2, filed on Jun. 29, 2020, and Chinese Patent Application No. CN 202021237149.9, filed on Jun. 29, 2020, which are incorporated by reference in their entirety herein.

BACKGROUND

Dust is generated when an electric tool (such as a grinding device) is used to process a workpiece. The dust not only pollutes the air but also exposes an operator to a dust environment. Therefore, the electric tool is typically equipped with a dust collecting device.

The electric tool is typically provided with the dust collecting device. The dust collecting device is typically provided with a dust separating part. The dust is left in the dust collecting device after being separated by the dust separating part, and a dust exhaust airflow is discharged out of the device. Therefore, when the dust is accumulated to an outlet of the dust separating part, the dust flies out of a dust collecting box along with the dust exhaust airflow. At this time, the dust collecting box is unable to effectively store the dust, and the dust in the dust collecting device needs to be dumped so as to ensure continuous dust collection. However, the dust separating part of the dust collecting device is typically disposed along an axial direction of a dust inlet in the existing art. Therefore, a space in the dust collecting device cannot be effectively utilized, and the frequency of dust dumping of a user is increased, which is not conducive to improving use feeling of the user.

SUMMARY

A cyclone dust collecting device includes a dust collecting box including a dust entrance and a cavity formed by extension in a first direction, wherein the dust entrance communicates with a dust exhaust channel of a host machine, and a dust exhaust airflow enters the cavity through the dust entrance; and a separator including a dust inlet and a cyclone tube, wherein the dust inlet communicates with the dust entrance, the dust inlet is configured to guide the dust exhaust airflow into the cyclone tube, the cyclone tube extends in a second direction and is at least partially disposed in the dust collecting box, the cyclone tube includes a dust outlet and an air outlet disposed on the cyclone tube, the dust outlet is located in the cavity, and the air outlet communicates with an outside of the dust collecting box. The second direction obliquely intersects the first direction such that the dust outlet is higher than the dust inlet and the air outlet is lower than the dust inlet.

In one example, a vertical distance between a top wall and a bottom wall of the dust collecting box is H, the cyclone tube has a central axis, and a vertical distance between the central axis at the dust inlet and the bottom wall of the dust collecting box is h, wherein $0.5 \leq h/H \leq 0.9$.

In one example, the first direction and the second direction obliquely intersect each other in a vertical plane and have an included angle in between, and the included angle is greater than or equal to 15° and less than or equal to 45°.

In one example, the cyclone tube includes a guide piece disposed at the air outlet, and the guide piece is configured to guide an air-out direction at the air outlet to deviate toward a direction away from the host machine with respect to the second direction.

In one example, the dust collecting box further includes an end cover and a dust cylinder which are detachably connected to each other, the end cover is detachably connected to the host machine, the cavity is formed in the dust cylinder, and the dust inlet is formed on the end cover.

In one example, the dust collecting box further includes a dust blocking piece, the dust cylinder is provided with an opening facing the host machine, and the dust blocking piece is disposed on a bottom wall at the opening of the dust cylinder.

In one example, the cyclone dust collecting device further includes a mounting structure disposed between the end cover and the dust cylinder, and the dust cylinder and the end cover are detachably connected to each other through the mounting structure.

In one example, the mounting structure includes an elastic buckle, and two elastic buckles are provided and disposed on opposite two sides of the dust cylinder.

In one example, the elastic buckle includes an elastic arm disposed on the dust cylinder, wherein the elastic arm is provided with a protrusion portion; and a claw disposed on the end cover, wherein the claw is provided with a groove which is fitted with the protrusion portion for locking.

In one example, the mounting structure includes a limiting protrusion disposed on the end cover; and a rotation buckle disposed on the dust cylinder, the rotation buckle is pivotally connected to the dust cylinder, the rotation buckle includes a hook portion and a biasing member, and the biasing member is configured to apply, to the hook portion, a biasing force which enables the hook portion to be fitted with the limiting protrusion for locking.

In one example, the dust collecting box includes a second joint for connecting a first joint of the host machine, and the second joint is detachably connected to the first joint through a locking member.

In one example, the locking member includes a first locking member disposed on one of the first joint and the second joint, wherein the first locking member is a protrusion radially protruding from the one of the first joint and the second joint; and a second locking member disposed on an outer periphery of the other joint of the first joint and the second joint, wherein the second locking member includes a sliding groove which is suitable for entry and locking of the first locking member, the sliding groove includes a guide groove and a locking groove, the guide groove is disposed obliquely with respect to an axis of the other joint, and the locking groove is disposed at an end of the guide groove and configured to restrict the first locking member from disengaging from the locking groove.

In one example, the guide groove is an arc groove, two protrusions and two sliding grooves are provided, the two protrusions are symmetrically disposed about an axis of the first joint, and the two sliding grooves are respectively disposed on opposite two sides of an outer periphery of the second joint.

In one example, the cyclone dust collecting device further includes an auxiliary disengaging member, the auxiliary disengaging member is sandwiched between the first joint and the second joint and has a biasing force applied to the second joint to disengage the second joint from the first joint, the second joint is sleeved on the first joint, the auxiliary disengaging member is an elastic cushion, and the elastic cushion engages with an inner wall of the second joint.

In one example, the dust collecting box further includes an end cover and a dust cylinder, the dust cylinder is provided with a top wall and a bottom wall, the second direction is arranged obliquely relative to the top wall, and the second direction is also arranged obliquely relative to the bottom wall.

A cyclone dust collecting device includes a dust collecting box including a dust entrance and a cavity formed by extension in a first direction, wherein the dust entrance communicates with a dust exhaust channel of a host machine, and a dust exhaust airflow enters the cavity through the dust entrance; and a separator including a dust inlet and a cyclone tube, wherein the dust inlet communicates with the dust entrance, the dust inlet is configured to guide the dust exhaust airflow into the cyclone tube, the cyclone tube extends in a second direction and is at least partially disposed in the dust collecting box, the cyclone tube includes a dust outlet and an air outlet disposed on the cyclone tube, the dust outlet is located in the cavity, and the air outlet communicates with an outside of the dust collecting box. The second direction obliquely intersects the first direction.

A grinding device includes a body including a dust exhaust channel; a baseplate assembly including a baseplate for mounting a grinding member; a driving mechanism disposed in the body, wherein the driving mechanism is configured to drive the baseplate assembly to move; a fan assembly is configured to form a dust exhaust air path; and a cyclone dust collecting device. The cyclone dust collecting device includes a dust collecting box including a dust entrance and a cavity formed by extension in a first direction, wherein the dust entrance communicates with the dust exhaust channel, and the dust exhaust airflow enters the cavity through the dust entrance; and a separator including a dust inlet and a cyclone tube, wherein the dust inlet communicates with the dust entrance, the dust inlet is configured to guide the dust exhaust airflow into the cyclone tube, the cyclone tube extends in a second direction and is at least partially disposed in the dust collecting box, the cyclone tube includes a dust outlet and an air outlet, the dust outlet is located in the cavity, and the air outlet communicates with an outside of the dust collecting box. The second direction obliquely intersects the first direction such that the dust outlet is higher than the dust inlet and the air outlet is lower than the dust inlet.

In one example, a vertical distance between a top wall and a bottom wall of the dust collecting box is H, the cyclone tube has a central axis, and a vertical distance between the central axis at the dust inlet and the bottom wall of the dust collecting box is h, wherein $0.5 \leq h/H \leq 0.9$.

In one example, the included angle exists between the first direction and the second direction in a vertical plane, and the included angle is greater than or equal to 15° and less than or equal to 45°.

In one example, the dust collecting box further includes an end cover and a dust cylinder, the dust cylinder further includes a dust blocking piece, the dust cylinder is provided with an opening facing the body, and the dust blocking piece is disposed on a bottom wall at the opening of the dust cylinder.

In the cyclone dust collecting device provided by the present disclosure, an included angle exists between the second direction and the first direction such that the inlet is higher than the dust inlet and the outlet is lower than the dust inlet. Therefore, the cyclone is obliquely disposed in the dust collecting box, a size of the dust collecting box in the axial direction is reduced, and the internal structure of the dust collecting box is more compact. The dust flows upward from the dust inlet and enters the dust collecting box at the inlet and accumulates in the dust collecting box. Since the inlet of the cyclone is raised, an effective dust accumulation space below an end portion is increased, and the dust collection space is increased without increasing a volume of the dust collecting box. In this manner, the dust collecting efficiency is higher, and the frequency of dust dumping of a user is reduced. At the same time, the outlet is disposed facing away from the host machine so that the dust exhaust airflow is prevented from blowing to the host machine and part of the dust that has not been effectively collected is prevented from blowing to the body along with the outlet of the separator.

DETAILED DESCRIPTION

Figure 1:
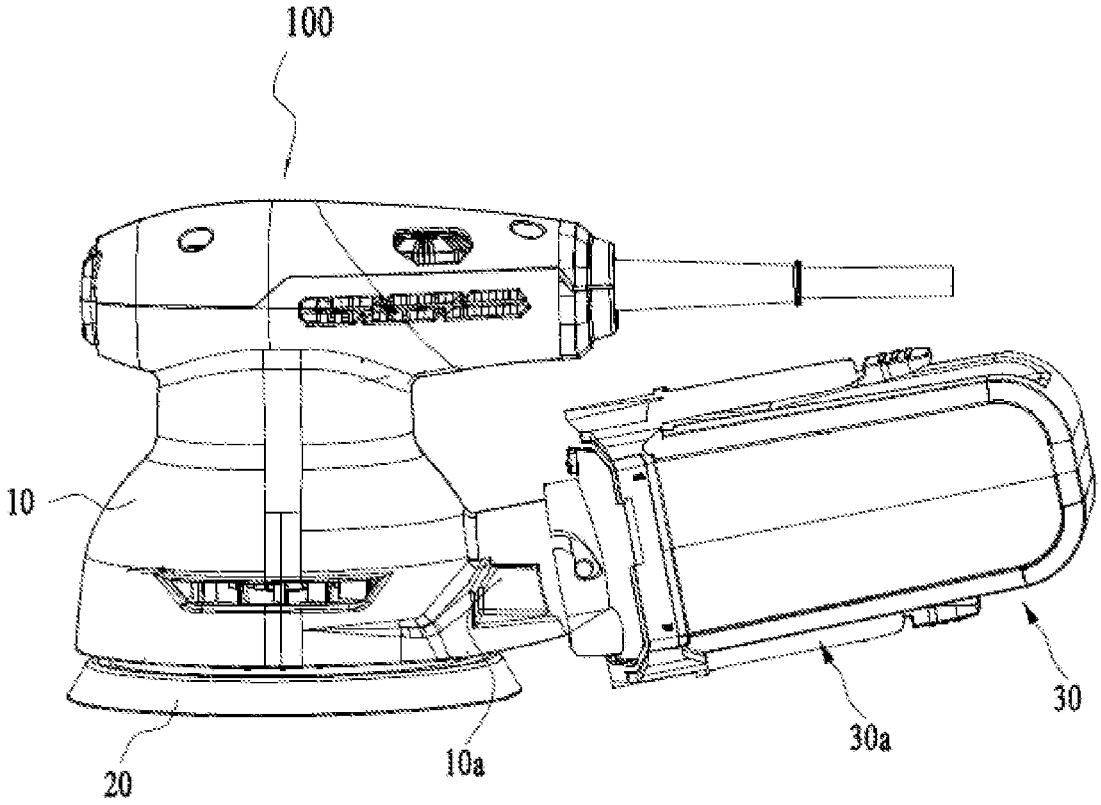
FIG. 1 is a structure view of a sander according to the present disclosure.

An example of the present disclosure provides a grinding device, and a sander is used as an example. Referring to FIG. 1, a host machine 100 of the sander includes at least a body 10, a baseplate assembly 20, a driving mechanism and a fan assembly. The top of the body 10 is formed with a holding portion for a user to hold, and the body 10 is configured to accommodate the driving mechanism and the fan assembly.

The baseplate assembly 20 is configured to fix a grinding member for implementing the functions of grinding and polishing. The baseplate assembly 20 includes a baseplate 21, one side of the baseplate 21 facing the body 10 is connected to the body 10 through a vibration bracket, and another side of the baseplate 21 is used for fixing the grinding member such as a sandpaper.

The driving mechanism is configured to drive the baseplate assembly 20 to move and includes a motor. An output shaft of the motor is connected to the baseplate assembly 20 in a transmission manner so that the baseplate assembly 20 is driven to move, thereby implementing functions of grinding and polishing of the sander.

The fan assembly is used for forming a dust exhaust air path, the body 10 is provided with a dust exhaust channel

10*a*, and the dust exhaust channel 10*a* includes a dust outlet disposed on one side of the body 10. Dust is generated when the grinding piece acts on a workpiece. The sandpaper and the baseplate 21 are provided with a dust exhaust hole, air and the dust are sucked into the dust exhaust channel 10*a* in the body 10 through the dust exhaust hole, and a dust exhaust airflow mixed with dust flows out from the dust exhaust channel 10*a*.

Figure 2:
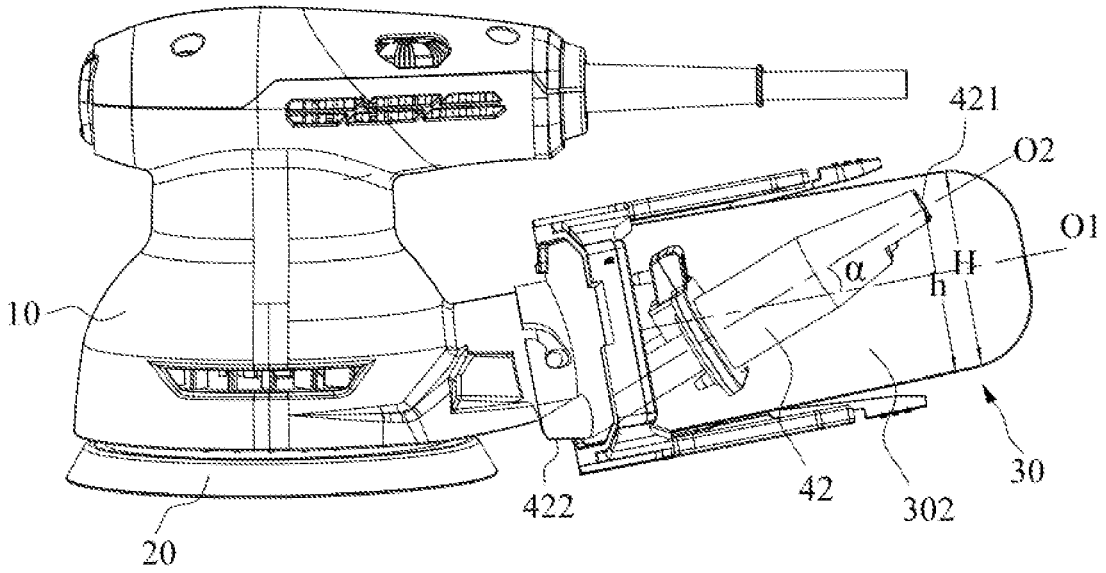
FIG. 2 is a sectional view of a part of the sander of FIG. 1.
Figure 3:
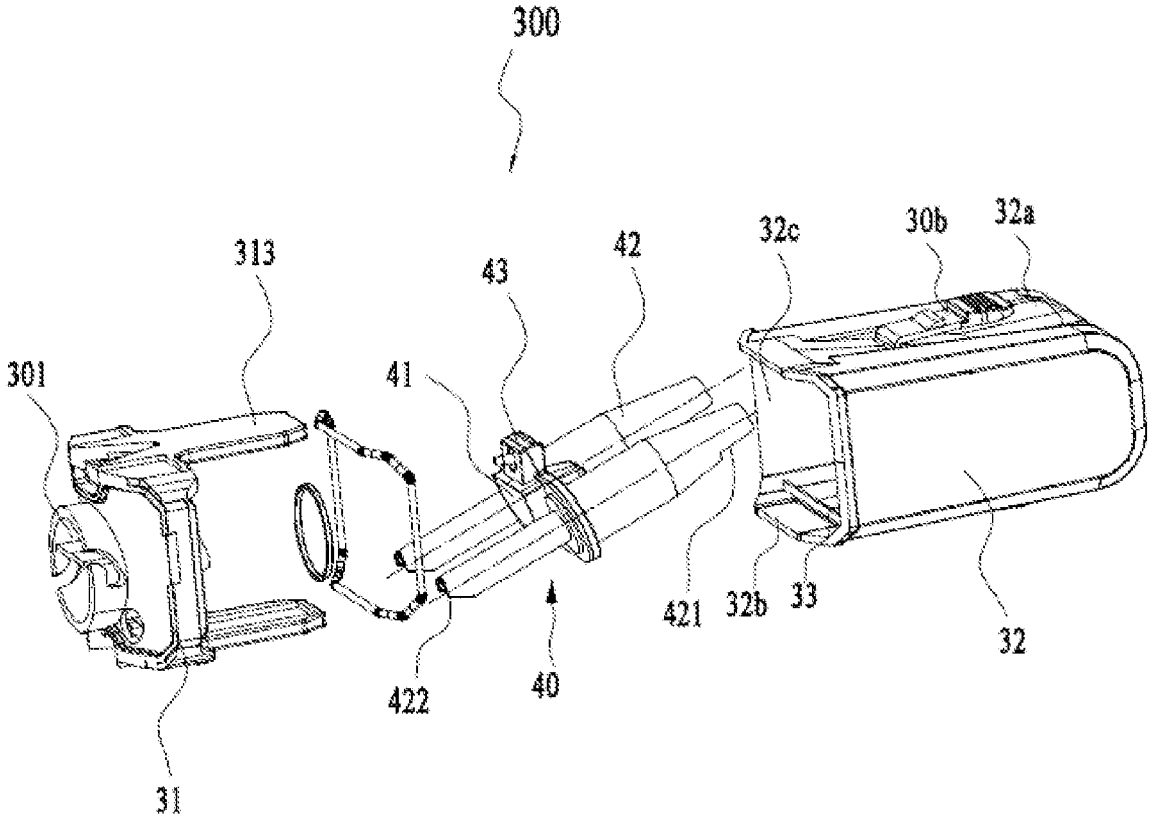
FIG. 3 is an exploded view of a cyclone dust collecting device of the sander of FIG. 1.

Referring to FIGS. 2 and 3, the sander provided by the example of the present disclosure further includes a cyclone dust collecting device 300, the dust exhaust airflow flows out from the dust exhaust channel 10*a* of the body to the cyclone dust collecting device 300, and the cyclone dust collecting device 300 separates the air from the dust and collects the dust in the dust collecting device.

Referring to FIGS. 2 and 3, the cyclone dust collecting device 300 in the example of the present disclosure includes a dust collecting box 30 and a separator 40. The dust collecting box 30 includes a dust entrance 301 and a cavity 302 formed by extension in a first direction. The dust entrance 301 communicates with a dust outlet of the dust exhaust channel 10*a* of the host machine 100, and the dust exhaust airflow enters the cavity 302 through the dust entrance 301.

Figure 7:
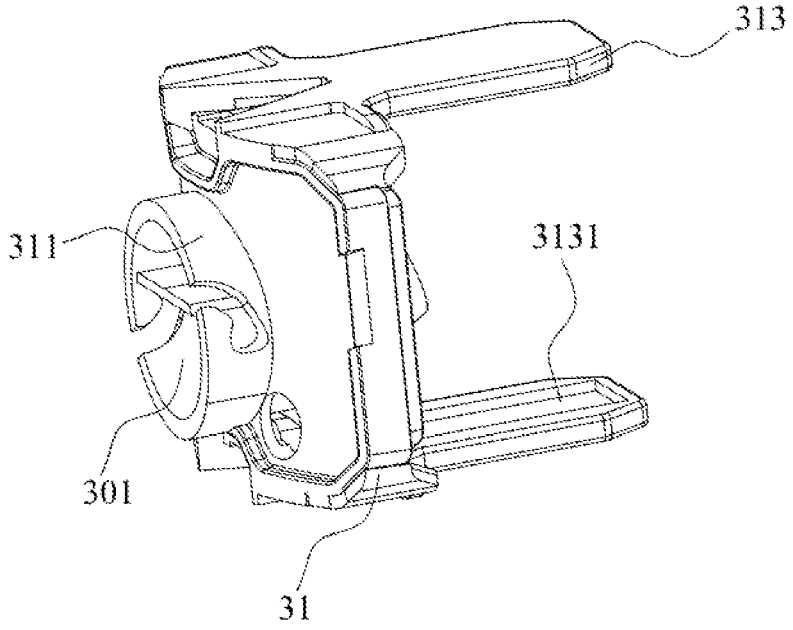
FIG. 7 is a structure view of an end cover of FIG. 3.
Figure 8:
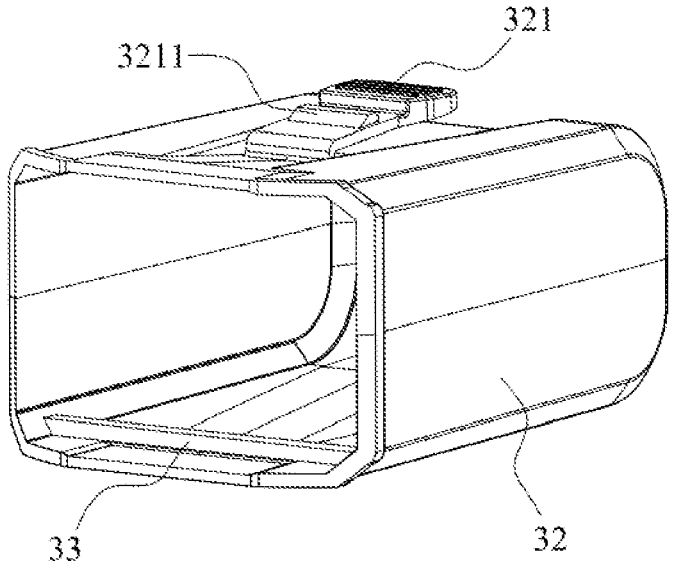
FIG. 8 is a structure view of a dust cylinder of FIG. 3.
Figure 9:
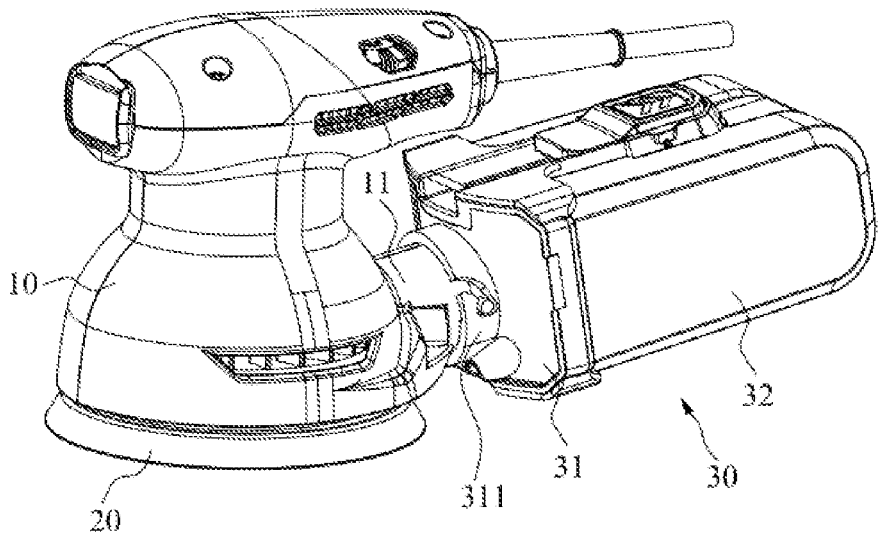
FIG. 9 is a structure view of a sander including another cyclone dust collecting device according to the present disclosure.
Figure 10:
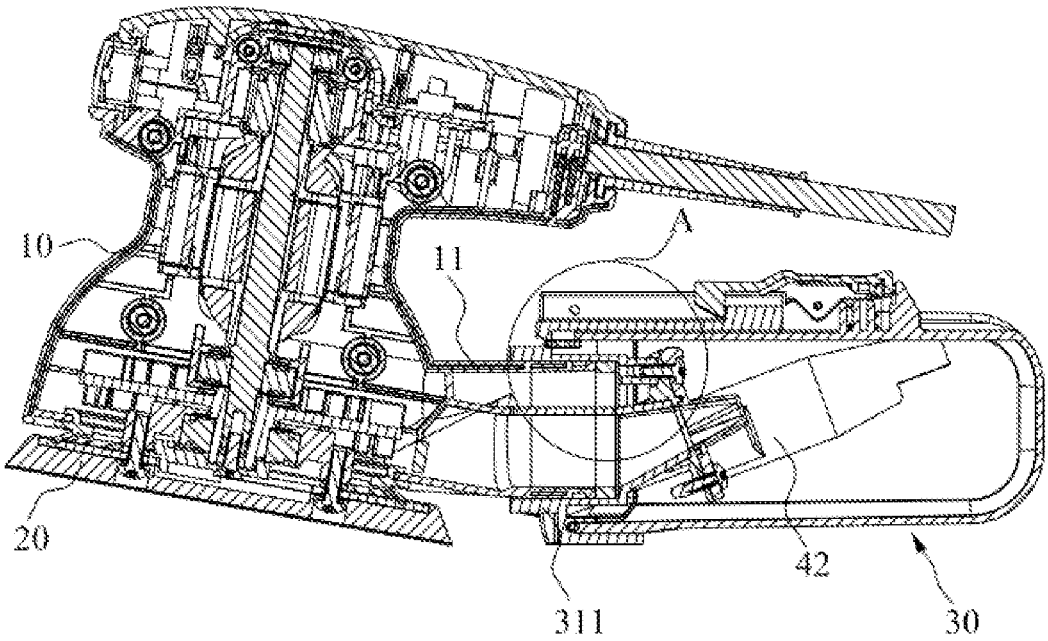
FIG. 10 is a sectional view of the sander of FIG. 9.

Referring to FIGS. 3, 7 and 8, the dust collecting box 30 includes an end cover 31 and a dust cylinder 32 which are detachably connected to each other, the end cover 31 is detachably connected to the body 10, the cavity 302 is formed in the dust cylinder 32, and the dust entrance 301 is formed on the end cover 31. The end cover 31 and the dust cylinder 32 of the dust collecting box 30 are detachably connected to each other so that it is convenient to open the end cover to dump the dust. Specifically, as shown in FIGS. 9 and 10, the body 10 of the host machine 100 includes a first joint 11 extending into a tubular shape, and an opening of the tubular first joint 11 is formed with the dust outlet. As shown in FIGS. 7, 9 and 10, the dust collecting box 30 includes a second joint 311, and as shown in FIG. 2, an open end of the second joint 311 is formed with the dust entrance 301.

The separator 40 in the example of the present disclosure includes a mounting base 43 and a cyclone tube 42. The mounting base 43 is connected to the end cover 31 and is provided with a dust inlet 41. The mounting base is provided with the dust inlet 41, the dust inlet 41 communicates with the dust entrance 301, and the cyclone tube 42 extends in a second direction and is at least partially disposed in the dust collecting box 30.

Two cyclones 42 are provided and disposed in parallel, and the two cyclones 42 are both connected to the mounting base 43. The cyclone tube 42 includes a separating cylinder disposed at a rear end of the mounting base 43 (the rear end refers to the right side in FIG. 3, that is, one end away from the host machine 100) and an air-outlet cylinder disposed at a front end of the mounting base 43 (the front end refers to the left side in FIG. 3, that is, one end facing to the host machine 100). A rear end of the separating cylinder is provided with a dust outlet 421 for the dust exhaust airflow to enter, and the dust outlet 421 is located in the cavity 302. A front end of the air-outlet cylinder is provided with an air outlet 422 for the dust exhaust airflow to discharge, and the air outlet 422 is used for communicating with an outside of the dust collecting box 30. The end cover 31 is provided with two through holes corresponding to the air-outlet cylinders, and the air-outlet cylinders of the cyclone tube 42 pass through the through holes on the end cover 31 and communicate with the outside of the dust collecting box 30.

The air carrying the dust enters the cavity 302 from the dust entrance 301 and the dust inlet 41, the dust is separated and collected into the dust collecting box 30 after rotating around an outer periphery of a separating cylinder, and finally, the dust exhaust airflow enters the cyclone tube 42 through the dust outlet 421 of the cyclone tube 42 and is discharged out of the dust collecting box 30 through the air outlet 422 of the air-outlet cylinder.

Referring to FIG. 2, in this example, the first direction refers to an axial direction of the dust entrance 301, and the second direction refers to an axial direction of the cyclone tube 42. The second direction obliquely intersects the first direction. Specifically, the second direction obliquely intersects the first direction in a vertical plane. It may also to be understood that the second direction obliquely intersects the first direction in a plane perpendicular to a bottom wall 32*b* of the dust collecting box. In this manner, the dust outlet 421 of the cyclone is higher than the dust inlet 41, and the air outlet 422 of the cyclone tube 42 is lower than the dust inlet 41, so that the cyclone tube 42 being obliquely disposed in the dust collecting box 30 is implemented.

Specifically, an included angle between the first direction and the second direction in the vertical plane is greater than or equal to 15° and less than or equal to 45°. In FIG. 2, the first direction is denoted by O1 and the second direction is denoted by O2, and the included angle between the first direction and the second direction is denoted by $\alpha$.

On the one hand, the cyclone inclines within the above-mentioned angle so that the reduction of an axial size (that is, a size of the dust collecting box in the front and rear direction) of the dust collecting box 30 is facilitated and a volume of the dust collecting box 30 is smaller. On the other hand, since the dust outlet 421 of the cyclone tube 42 is raised, an effective dust accumulation space located below the dust outlet 421 is increased, the dust collection efficiency is higher, and the frequency of dust dumping of a user is reduced. Therefore, the effective dust accumulation space is ensured on the basis of reducing the volume of the dust collecting box, and the reduction of the dust accumulation space is avoided.

Figure 6:
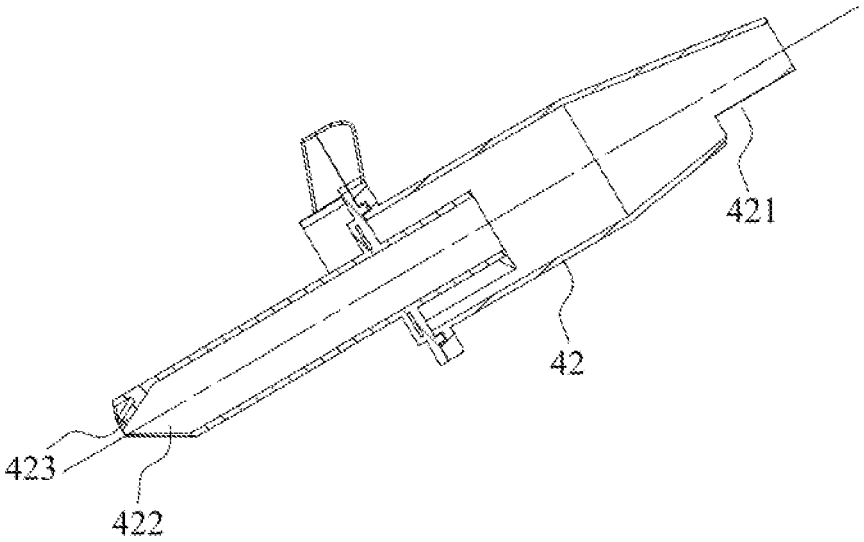
FIG. 6 is a sectional view of a cyclone tube of FIG. 5.

Referring to FIG. 6, in the example of the present disclosure, the air outlet 422 of the cyclone tube 42 is disposed away from the host machine 100. Specifically, the cyclone tube 42 in the example of the present disclosure includes a guide piece 423 disposed at the air outlet 422. The guide piece 423 is configured to guide an air-out direction at the air outlet 422 to deviate toward a direction away from the host machine 100 with respect to the second direction. The guide piece 423 changes the air-out direction at the air outlet 422 so that residual dust carried in an exhaust airflow is avoided from being sprayed and accumulated on the body of the host machine 100.

The air outlet 422 is disposed facing away from the host machine 100. Specifically, the air outlet 422 may be disposed facing an operating table or a rear end of the body; or the air outlet 422 is disposed obliquely relative to the baseplate assembly such that the air outlet 422 discharges air flow toward lower rear part of the body.

Since the air outlet 422 of the cyclone tube 42 is disposed facing away from the host machine 100, a dust exhaust airflow that still carries a small amount of dust may be prevented from being blown onto the body 10 of the host machine 100, thereby preventing the dust from accumulating on the body and ensuring the cleanliness and beauty of the appearance of the host machine 100.

Referring to FIG. 2, in this example of the present disclosure, a vertical distance between a top wall 32*a* and a bottom wall 32*b* of the dust collecting box 30 is H, a vertical distance between a central axis of the cyclone tube 42 at the dust outlet 421 and the bottom wall 32*b* of the dust collecting box 30 is h, and the central axis of the cyclone tube 42 is shown as the second direction O2. H and h are shown in FIG. 2, where 0.5≤h/H≤0.9. In this example, h/H is 0.5, 0.6, or 0.8. Specifically, the central axis at the inlet refers to a position where the dust outlet 421 intersects the axis of the cyclone so that the dust outlet 421 is as close as possible to the top of the dust collecting box 30, and a position of the dust outlet 421 is higher than a middle position of the dust collecting box 30 so that the effective dust accumulation space located below the dust outlet 421 is increased, the dust collection efficiency is higher, and the frequency of dust dumping of the user is reduced.

Figure 4:
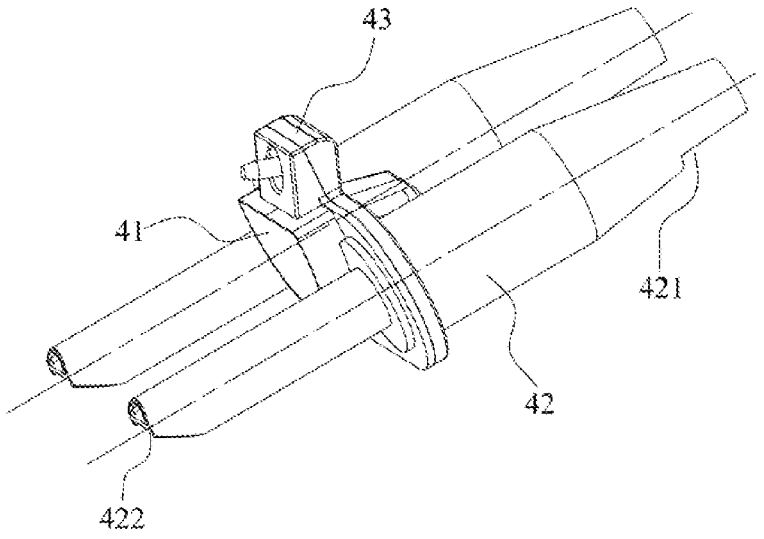
FIG. 4 is a structure view of a separator of FIG. 3.
Figure 5:
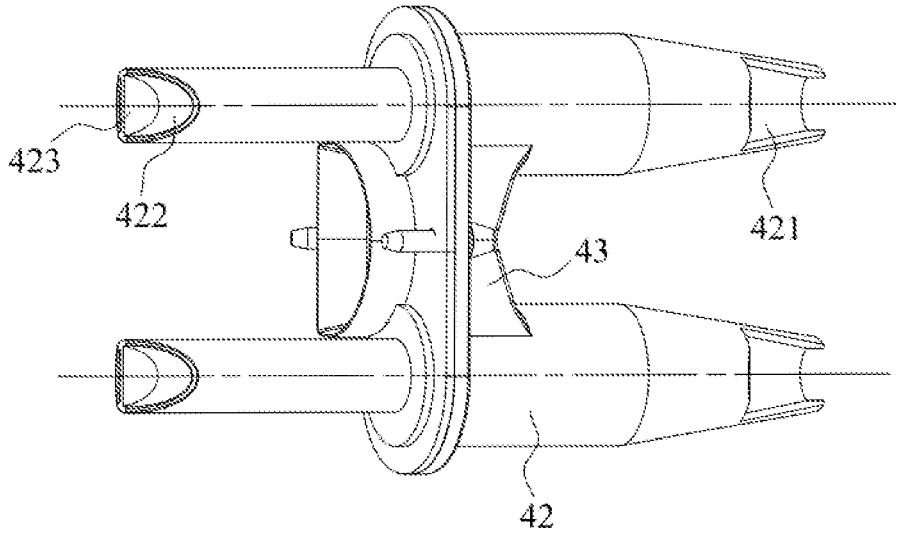
FIG. 5 is a bottom view of the separator of FIG. 4.

Referring to FIGS. 4 to 6, the separator 40 includes two cyclones 42, the two cyclones 42 share one dust inlet 41, and each cyclone tube 42 is provided with the dust outlet 421 and the air outlet 422.

Referring to FIG. 8, the dust collecting box 30 further includes a dust blocking piece 33, the dust cylinder 32 is provided with an opening 32*c* facing the host machine 100, and the dust blocking piece 33 is disposed on a bottom wall 32*b* at an opening 32*c* of the dust cylinder 32. The dust blocking piece 33 is capable of preventing the dust in the dust cylinder 32 from falling when the end cover 31 is disengaged from the dust cylinder 32. The dust blocking piece 33 may be a plastic piece or a gasket. The dust blocking piece 33 may be integrally formed with the dust collecting box or may be separately formed and then mounted in the dust collecting box, which is not limited herein.

Referring to FIG. 3, in the example of the present disclosure, the end cover 31 and the dust cylinder 32 of the dust collecting box 30 are detachably connected to each other. Specifically, the sander further includes a mounting structure 30*a* disposed between the end cover 31 and the dust cylinder 32. The dust cylinder 32 is detachably connected to the end cover 31 through the mounting structure 30*a*, where the mounting structure 30*a* may be an engagement structure.

In this example, the mounting structure 30*a* includes an elastic buckle 30*b*, and two elastic buckles 30*b* are provided and disposed on opposite two sides of the dust cylinder 32. During mounting, the end cover 31 is inserted into the dust cylinder 32 so that the elastic buckle 30*b* implements locking. The arrangement of the elastic buckle 30*b* facilitates mounting and disassembly.

Referring to FIGS. 7 and 8, specifically, in this example, the elastic buckles 30*b* are disposed on upper and lower sides of the dust collecting box 30, and the elastic buckle 30*b* includes an elastic arm 321 and a claw 313. A pair of elastic arms 321 are disposed on upper and lower sides of the dust cylinder 32. Each elastic arm 321 is provided with a protrusion portion 3211. A pair of claws 313 are correspondingly disposed on upper and lower sides of the end cover 31, and each claw 313 is provided with a groove 3131 that is fitted with the protrusion portion 3211 for locking. When the end cover is mounted, the claw 313 is inserted into an outside of the elastic arm 321, the elastic arm 321 is compressed toward an inner side of the dust collecting box 30 and deformed with the insertion of the claw 313, and when the claw 313 is mounted to a predetermined position, the protrusion portion 3211 outside the elastic arm 321 enters the groove 3131 inside the claw 313. At this time, the elastic arm is held in a locked state with the claw 313 under its own elastic biasing force so that the claw 313 cannot be disengaged from the dust collecting box 30. When the end cover is opened, a free end of the elastic arm 321 is pressed and since the elastic arm is compressed toward the inside of the dust collecting box, the protrusion portion 3211 on the elastic arm is disengaged from the groove 3131 inside the claw 313. At this time, the end cover 31 is allowed to be opened and disengaged from the dust collecting box 30.

Referring to FIGS. 9 to 14, in the example of the present disclosure, the dust collecting box 30 is detachably connected to the body 10. The second joint 311 of the dust collecting box 30 has a locked state in which the second joint 311 is fitted with the first joint 11 of the body 10 for locking and an open state in which the second joint 311 is disengaged from the first joint 11. When the second joint 311 is fitted with the first joint 11 for locking, the dust entrance 301 communicates with the dust outlet. For example, the first joint 11 and the second joint 311 may be locked in a threaded connection manner or in an engagement manner.

In this example, the first joint 11 is fitted with the second joint 311 for locking through a locking member. The locking member includes a first locking member and a second locking member. The first locking member is disposed on one of the first joint and the second joint, and the first locking member is radially protruding from the one joint. The second locking member is disposed on an outer periphery of the other joint of the first joint and the second joint, and the second locking member includes a sliding groove which is suitable for entry and locking of the first locking member.

Figure 12:
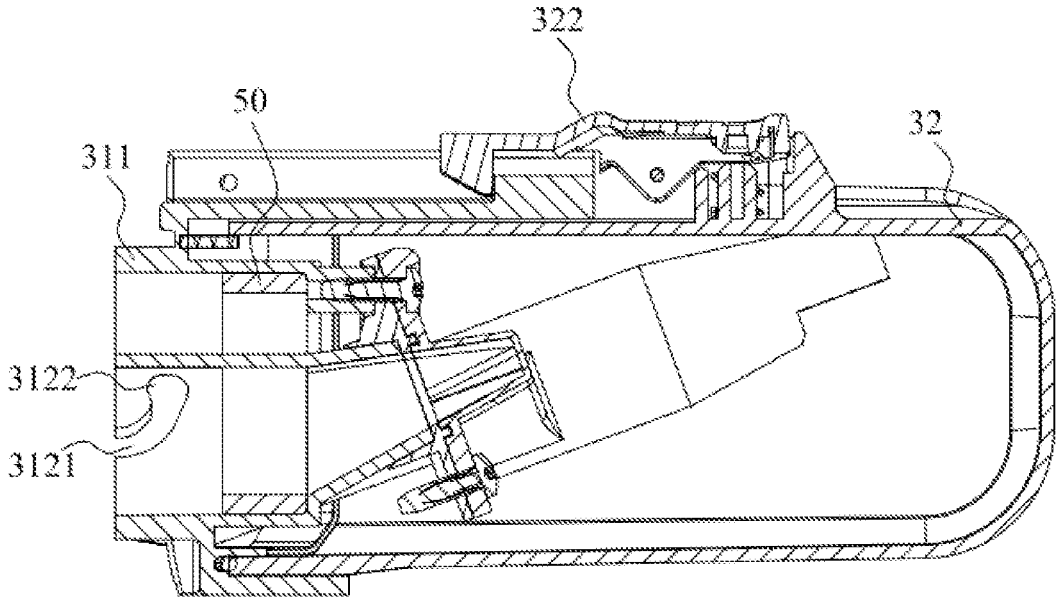
FIG. 12 is a sectional view of the cyclone dust collecting device of the sander of FIG. 10.
Figure 13:
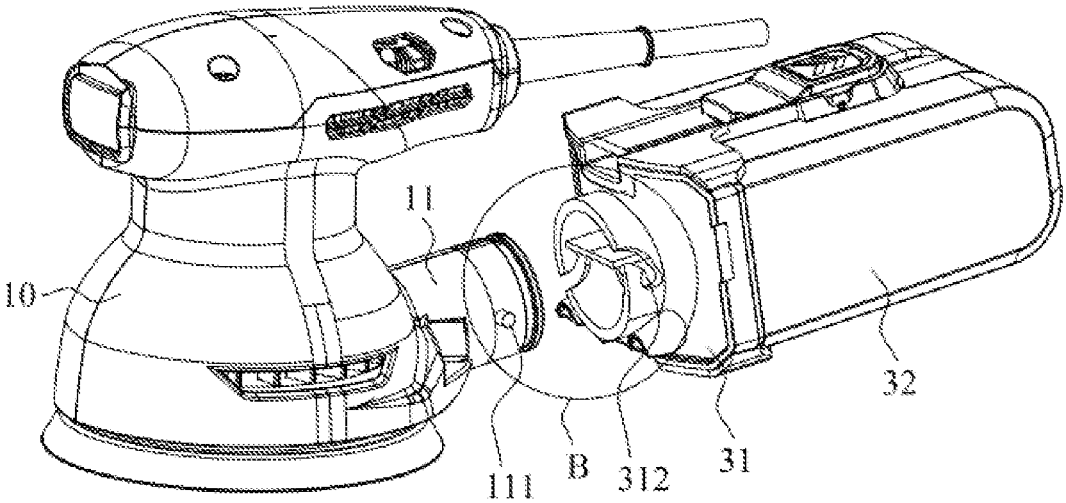
FIG. 13 is an exploded view of the sander of FIG. 9.
Figure 14:
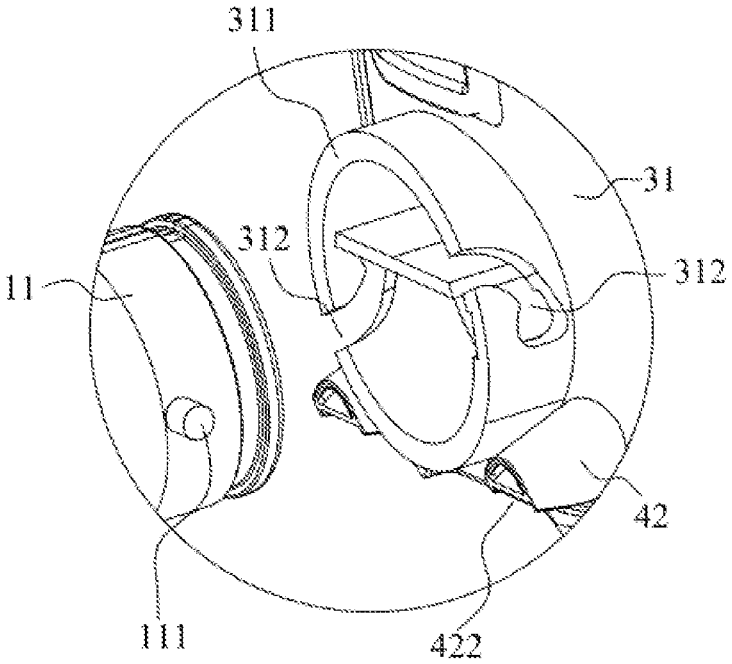
FIG. 14 is an enlarged view of a part B of FIG. 13.

Referring to FIGS. 12 to 14, in this example, the locking member includes the first locking member 111 and the second locking member, and the first locking member 111 is disposed on the first joint 11. Specifically, the first locking member 111 is a protrusion radially protruding from the first joint 11. The second locking member is disposed on the second joint 311 and includes the sliding groove 312 which is suitable for entry and locking of the protrusion. The sliding groove 312 includes a guide groove 3121 and a locking groove 3122, the guide groove 3121 is disposed obliquely on an outer periphery of the second joint 311 with respect to an axis of the second joint 311, and the locking groove 3122 is disposed at an end of the guide groove 3121 and configured to restrict the first locking member 111 from disengaging from the locking groove 3122 and entering the guide groove 3121. In this example, the guide groove 3121 is an arc groove, and the guide groove 3121 is connected to the locking groove 3122 in a smooth-transition manner. Therefore, it is ensured that the first locking member 111 can easily slide into the locking groove 3122 during locking, which facilitates convenient operation of the user and improves the operation hand feeling of the user. Of course, positions of the first locking member and the second locking member are interchangeable.

In this example, two protrusions and two sliding grooves 312 are provided, the two protrusions are symmetrically disposed about an axis of the first joint 11, and the two sliding grooves 312 are respectively disposed on opposite two sides of the outer periphery of the second joint 311.

Figure 11:
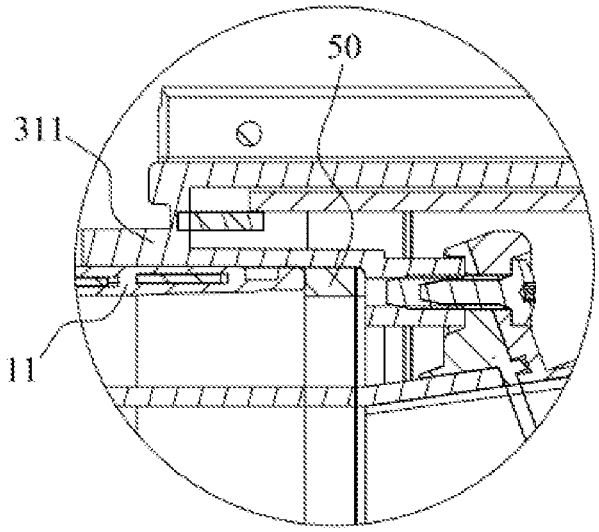
FIG. 11 is an enlarged view of a part A of FIG. 10.

Referring to FIGS. 11 and 12, the sander further includes an auxiliary disengaging member 50, the auxiliary disengaging member 50 is sandwiched between the first joint 11 and the second joint 311 and has a biasing force applied to the second joint 311 to disengage the second joint 311 from the first joint 11. When the second joint 311 is fitted with the first joint 11 in a locked state for locking, the first joint 11 and the second joint 311 press the auxiliary disengaging member 50 to elastically deform the auxiliary disengaging member 50. When the second joint 311 is disengaged from the first joint 11, the auxiliary disengaging member 50 generates a thrust force on the second joint 311 to assist in disengaging the second joint 311, thereby achieving rapid disassembly. On the other hand, the auxiliary disengaging member 50 may also play a function of auxiliary seal for the first joint and the second joint to ensure relative sealing of the first joint and the second joint.

In the example of the present disclosure, the auxiliary disengaging member 50 is specifically an elastic cushion, where the second joint 311 is sleeved on the first joint 11 so that an inner wall of the second joint 311 is annularly provided with a slot suitable for mounting the elastic cushion. Specifically, a position of an inner side of the second joint 311 corresponding to an end portion of the first joint 11 in an axial direction of the first joint is provided with the slot used for mounting the elastic cushion. Referring to FIG. 11, FIG. 11 illustrates the auxiliary disengaging member 50 in a compressed state, and when the dust collecting box 30 is mounted and fixed to the body, the first joint 11 abuts against and compresses the elastic cushion. Referring to FIG. 12, FIG. 12 illustrates the auxiliary disengaging member 50 in an uncompressed state, and when the dust collecting box 30 is removed from the body, the elastic cushion returns to a free state.

When the dust collecting box is mounted, the second joint 311 rotates in a locking direction and guides the protrusion to enter the guide groove 3121 of the sliding groove 312, and the second joint 311 is further rotated so that the protrusion enters the locking groove 3122 of the sliding groove 312. Since the locking groove 3122 is disposed at the end of the guide groove 3121 and an included angle exists between the locking groove 3122 and the guide groove 3121, the locking groove 3122 plays a function of limiting the protrusion and preventing the protrusion from sliding out along the guide groove 3121. During locking, the first joint 11 and the second joint 311 press the auxiliary disengaging member 50 to elastically deform the auxiliary disengaging member 50.

When the dust collecting box is disassembled, the protrusion is guided to slide into the guide groove 3121 from the locking groove 3122, and the auxiliary disengaging member 50 returns deformation to provide an elastic force for auxiliary unlocking so that the protrusion quickly slides out of the guide groove 3121, thereby achieving rapid disassembly. The dust collecting box 30 is fitted with the body 10 through the first joint 11 and the second joint 311, and rapid mounting and disassembly are achieved in a rotation manner so that the mounting is facilitated and time is saved. The auxiliary disengaging member 50 is used for providing the second joint 311 with the elastic force assisting the second joint 311 in being disengaged from the dust collecting box during unlocking so that the second joint 311 can be quickly bounced away from the first joint 11, thereby improving the disassembly efficiency.

An outer circumferential surface of the first joint 11 is provided with a recess for mounting a sealing ring, and the sealing ring is mounted in the recess and sandwiched between the inner wall of the second joint 311 and an outer wall of the first joint 11. The sealing ring mainly plays a function of sealing.

To sum up, the cyclone tube 42 is disposed obliquely in the dust collecting box 30 so that the axial size of the dust collecting box 30 can be reduced and the size of the dust collecting box 30 is small; and the dust flows upward from the dust inlet 41 and enters the dust collecting box 30 at the dust outlet 421 and accumulates in the dust collecting box 30, and since the dust outlet 421 of the cyclone tube 42 is raised, the effective dust accumulation space below the end portion of the cyclone tube 42 is increased. Therefore, the dust collecting efficiency is higher without increasing the volume of the dust collecting box, and the frequency of dust dumping of the user is reduced.

FIGS. 9 to 16 show a sander including another cyclone dust collecting device 300, where the structure of the host machine 100 of the sander and the main parts of the dust collecting box are the same as those described in the previous example and will not be repeated here. The same or corresponding parts as those described in the previous example are given the same reference numerals as those described in the previous example. The difference from the previous example is that the mounting structure 30*a* used for disassembling the dust cylinder and the end cover of the dust collecting box is different.

Figure 15:
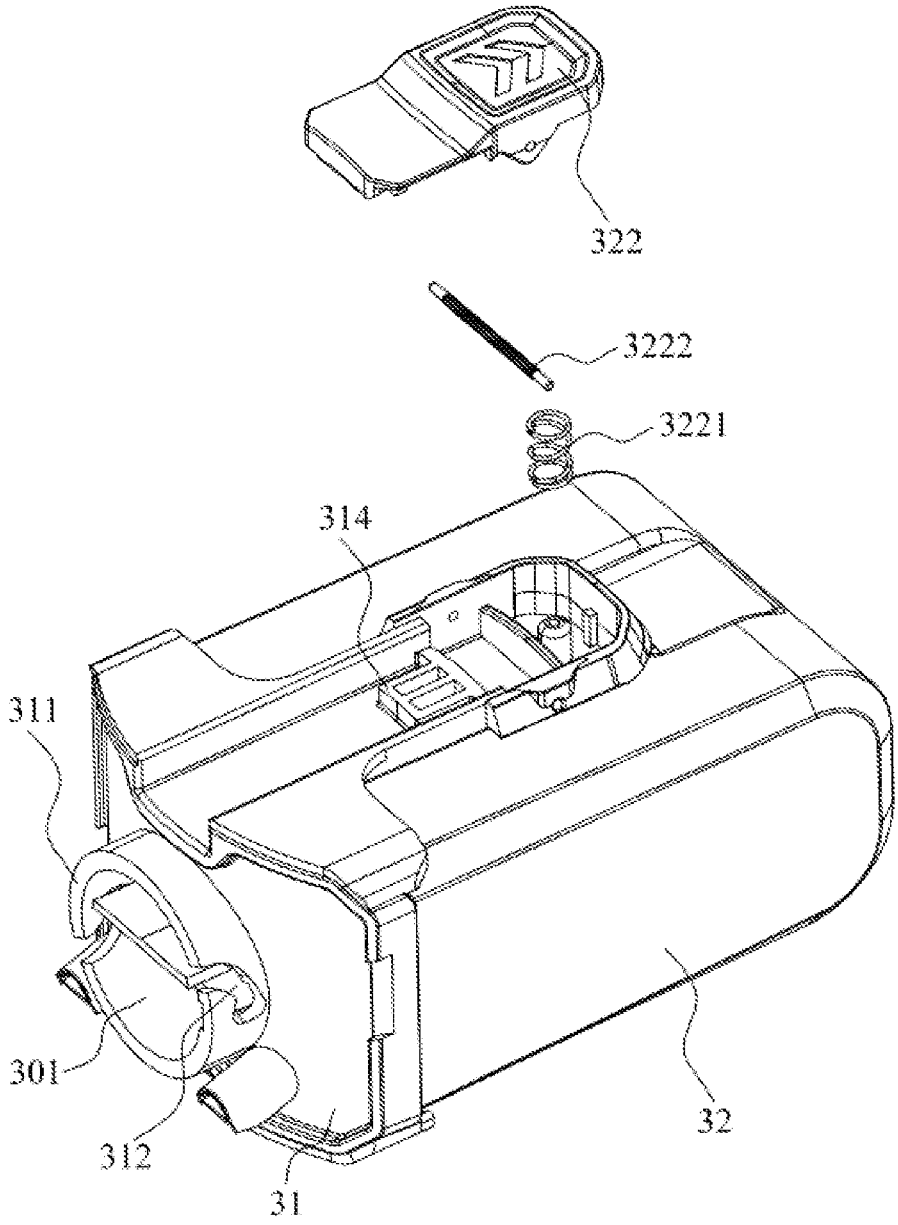
FIG. 15 is an exploded view of a dust collecting box of FIG. 9.
Figure 16:
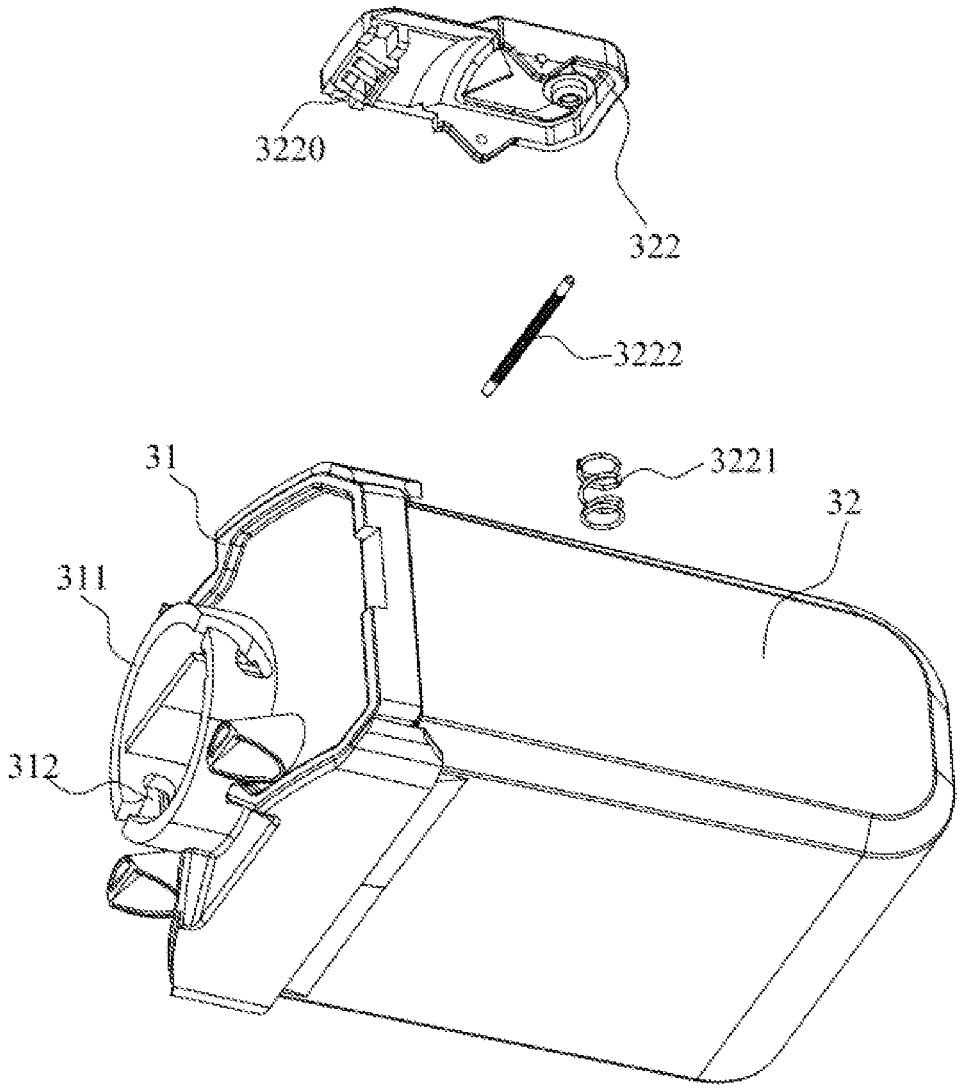
FIG. 16 is an exploded view of a dust collecting box of FIG. 9 from another perspective.

In this example, the mounting structure 30*a* between the dust collecting box 30 and the body 10 includes a rotation buckle 322 and a limiting protrusion 314. Specifically, as shown in FIGS. 15 and 16, the limiting protrusion 314 is disposed on the end cover 31, the rotation buckle 322 is disposed on the dust cylinder 32, and the rotation buckle 322 is pivotally connected to the dust cylinder 32 through a rotating shaft 3222. The rotation buckle 322 includes a hook portion 3220 and a biasing member 3221, and the biasing member 3221 is configured to apply a biasing force, to the hook portion 3220, which enables the hook portion 3220 to be fitted with the limiting protrusion 314 for locking. The biasing member 3221 is a spring, and the spring and the limiting protrusion 314 are respectively disposed on two sides of the rotating shaft 3222.

During mounting, one end of the rotation buckle 322 is pressed such that the rotation buckle 322 is rotated relative to the dust cylinder 32; the end cover 31 is buckled at an opening of the dust cylinder 32 so that the limiting protrusion 314 is located below the hook portion 3220 of the rotation buckle 322; the rotation buckle 322 is released, and the hook portion 3220 is engaged with the limiting protrusion 314; and since the biasing member 3221 applies the biasing force, to the hook portion 3220, which enables the hook portion 3220 to be fitted with the limiting protrusion 314 for locking, the buckle is in the locked state.

In this example, the locking between the end cover 31 and the dust cylinder 32 can be achieved with simply one rotation buckle 322, and the structure is simpler and the mounting and disassembly are easier through the single-side engagement manner. Of course, two rotation buckles disposed opposite to each other may also be provided, which is no limited herein.

Figure 17:
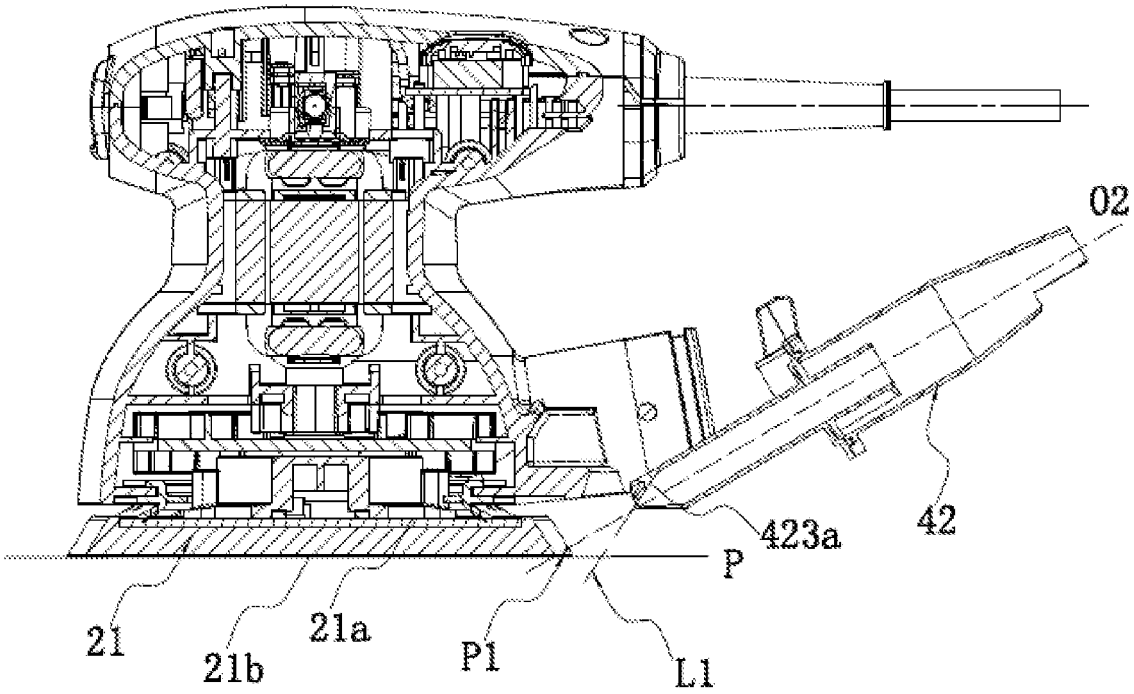
FIG. 17 is a sectional view of a portion of the sander of FIG. 1.

As shown in FIG. 17, the baseplate 21 comprise an upper surface 21*a* and a lower surface 21*b*, and the lower surface 21*b* extends alone a plane P. The intersection point P1 of central axis O2 of the cyclone tube 42 and the baseplate 21 is provided on the lower side of the upper surface 21*a* of the baseplate 21. The guide piece 423 is provided with a guide plane 423*a* for guiding the dust exhaust airflow to deviate from the central axis O2. The cross-sectional line L1 of the guide plane 423*a* in a vertical plane does not pass through the baseplate 21.

The above examples describe merely the basic principles and characteristics of the present disclosure and the present disclosure is not limited to the above examples. Various modifications and changes may be made in the present disclosure without departing from the spirit and scope of the present disclosure. These modifications and changes fall within the scope of the present disclosure. The scope of the present disclosure is defined by the appended claims and equivalents thereof.

What is claimed is:

1. A cyclone dust collecting device for a grinding device, comprising:

a dust collecting box comprising a dust entrance and a cavity formed by extension in a first direction wherein the dust entrance is adapted to communicate with a dust exhaust channel of the grinding device such that a dust exhaust airflow from the grinding device will enter the cavity through the dust entrance; and a separator comprising a dust inlet and a cyclone tube wherein the dust inlet communicates with the dust entrance, the dust inlet guides the dust exhaust airflow into the cyclone tube, the cyclone tube extends in a second direction and is at least partially disposed in the dust collecting box, the cyclone tube comprises a dust outlet and an air outlet disposed on the cyclone tube, the dust outlet is located in the cavity, the air outlet communicates with an outside of the dust collecting box, the dust outlet is higher than the dust inlet and the air outlet is lower than the dust inlet when the cyclone dust collecting device is mounted to and completely supported by the grinding device and the grinding device is placed above a working surface parallel to a horizontal plane and grinding said working surface.

2. The cyclone dust collecting device of claim 1, wherein a vertical distance between a top wall and a bottom wall of the dust collecting box is H, the cyclone tube has a central axis, a vertical distance between the central axis at the dust outlet and the bottom wall of the dust collecting box is h, and $0.5 \leq h/H \leq 0.9$.

3. The cyclone dust collecting device of claim 1, wherein the first direction and the second direction obliquely intersect each other in a vertical plane at an angle that is greater than or equal to 15° and less than or equal to 45°.

4. The cyclone dust collecting device of claim 1, wherein the cyclone tube comprises a guide piece disposed at the air outlet and the guide piece guides an air-out direction at the air outlet in a direction that is away from the grinding device with respect to the second direction.

5. The cyclone dust collecting device of claim 1, wherein the dust collecting box further comprises an end cover and a dust cylinder which are detachably connected to each other, the end cover is detachably connected to the grinding device, the cavity is formed in the dust cylinder, and the dust inlet is formed on the end cover.

6. The cyclone dust collecting device of claim 5, wherein the dust collecting box further comprises a dust blocking piece, the dust cylinder is provided with an opening facing the grinding device, and the dust blocking piece is disposed on a bottom wall at the opening of the dust cylinder.

7. The cyclone dust collecting device of claim 5, further comprising a mounting structure disposed between the end cover and the dust cylinder wherein the dust cylinder and the end cover are detachably connected to each other through the mounting structure.

8. The cyclone dust collecting device of claim 7, wherein the mounting structure comprises two elastic buckles that are provided and disposed on opposite two sides of the dust cylinder.

9. The cyclone dust collecting device of claim 8, wherein each elastic buckle comprises an elastic arm disposed on the dust cylinder that is provided with a protrusion portion and a claw disposed on the end cover that is provided with a groove which is fitted with the protrusion portion for locking.

10. The cyclone dust collecting device of claim 7, wherein the mounting structure comprises a limiting protrusion disposed on the end cover and a rotation buckle disposed on the dust cylinder, wherein the rotation buckle is pivotally connected to the dust cylinder, the rotation buckle comprises a hook portion and a biasing member, and the biasing member applies a biasing force to the hook portion which enables the hook portion to be fitted with the limiting protrusion for locking.

11. The cyclone dust collecting device of claim 1, wherein the dust collecting box comprises a second joint for connecting to a first joint of the grinding device and the second joint is detachably connected to the first joint through a locking member.

12. The cyclone dust collecting device of claim 11, wherein the locking member comprises a first locking member and a second locking member, the first locking member is disposed on one of the first joint and the second joint, the first locking member is a protrusion radially protruding from the one of the first joint and the second joint, the second locking member is disposed on an outer periphery of the other joint of the first joint and the second joint, the second locking member comprises a sliding groove which is suitable for entry and locking of the first locking member, the sliding groove comprises a guide groove and a locking groove, the guide groove is disposed obliquely with respect to an axis of the other joint, and the locking groove is disposed at an end of the guide groove to restrict the first locking member from disengaging from the locking groove.

13. The cyclone dust collecting device of claim 12, wherein the guide groove is an arc groove, two protrusions and two sliding grooves are provided, the two protrusions are symmetrically disposed about an axis of the first joint, and the two sliding grooves are respectively disposed on opposite two sides of an outer periphery of the second joint.

14. The cyclone dust collecting device of claim 11, further comprising an auxiliary disengaging member wherein the auxiliary disengaging member is sandwiched between the first joint and the second joint and has a biasing force applied to the second joint to disengage the second joint from the first joint, the second joint is sleeved on the first joint, the auxiliary disengaging member is an elastic cushion, and the elastic cushion engages with an inner wall of the second joint.

15. The cyclone dust collecting device of claim 1, wherein the dust collecting box further comprises an end cover and a dust cylinder, the dust cylinder is provided with a top wall and a bottom wall, the second direction is arranged obliquely relative to the top wall, and the second direction is also arranged obliquely relative to the bottom wall.

16. A grinding device, comprising:

a body comprising a dust exhaust channel;

a baseplate assembly comprising a baseplate for mounting a grinding member;

a driving mechanism disposed in the body, wherein the driving mechanism drives the baseplate assembly to move;

a fan assembly forms a dust exhaust air path; and a cyclone dust collecting device comprising:

a dust collecting box comprising a dust entrance and a cavity formed by extension in a first direction wherein the dust entrance communicates with the dust exhaust channel and the dust exhaust air path enters the cavity through the dust entrance; and a separator comprising a dust inlet and a cyclone tube wherein the dust inlet communicates with the dust entrance, the dust inlet guides the dust exhaust air path into the cyclone tube, the cyclone tube extends in a second direction and is at least partially disposed in the dust collecting box, the cyclone tube comprises a dust outlet and an air outlet, the dust outlet is located in the cavity, the air outlet communicates with an outside of the dust collecting box, and the dust outlet is higher than the dust inlet and the air outlet is lower than the dust inlet when the cyclone dust collecting device is mounted to and completely supported by the grinding device and the grinding device is placed above a working surface parallel to a horizontal plane and grinding said working surface.

17. The grinding device of claim 16, wherein a vertical distance between a top wall and a bottom wall of the dust collecting box is H, the cyclone tube has a central axis, a vertical distance between the central axis at the dust outlet and the bottom wall of the dust collecting box is h, and $0.5 \leq h/H \leq 0.9$.

18. The grinding device of claim 16, wherein an included angle exists between the first direction and the second direction in a vertical plane and the included angle is greater than or equal to 15° and less than or equal to 45°.

19. The grinding device of claim 16, wherein the dust collecting box further comprises an end cover and a dust cylinder, the dust cylinder further comprises a dust blocking piece, the dust cylinder is provided with an opening facing the body, and the dust blocking piece is disposed on a bottom wall at the opening of the dust cylinder.

* * * * *